United States Patent [19]

McDade

[11] Patent Number: 4,903,447

[45] Date of Patent: Feb. 27, 1990

[54] LOG PROFILE AND LOG STRUCTURE INCORPORATING SAID LOG PROFILE

[76] Inventor: Paul R. McDade, 3900 Union School Rd., Oxford, Pa. 19363

[21] Appl. No.: 368,914

[22] Filed: Jun. 19, 1989

Related U.S. Application Data

[63] Continuation of Ser. No. 194,445, May 16, 1988, abandoned.

[51] Int. Cl.[4] ..... E04B 1/10; E04C 1/10

[52] U.S. Cl. ..... 52/233; 52/533; 52/595

[58] Field of Search ..... 52/233, 533

[56] References Cited

U.S. PATENT DOCUMENTS

| | | | |
|---|---|---|---|
| 634,562 | 10/1899 | Pagnon | 52/595 |
| 2,321,120 | 6/1943 | Baker | 20/4 |
| 3,185,266 | 5/1965 | Hofmeister | 52/403 |
| 3,440,784 | 4/1969 | Onjukka | 52/595 |
| 3,969,859 | 7/1976 | Hisey | 52/233 |
| 4,047,350 | 9/1977 | Chisum | 52/593 |
| 4,126,977 | 11/1978 | Chisum | 52/233 |
| 4,154,036 | 5/1979 | Moss et al. | 52/282 |
| 4,312,161 | 1/1982 | Goldade | 52/233 |
| 4,344,263 | 8/1982 | Farmont | 52/233 |
| 4,356,676 | 11/1982 | Hauptman | 52/403 |
| 4,391,067 | 7/1983 | Frady et al. | 52/97 |
| 4,391,077 | 7/1983 | Giess | 52/747 |
| 4,429,500 | 2/1984 | Farmont | 52/233 |
| 4,488,389 | 12/1984 | Farmont | 52/233 |
| 4,599,837 | 7/1986 | Wrightman | 52/233 |

FOREIGN PATENT DOCUMENTS

| | | | |
|---|---|---|---|
| 1373787 | of 1963 | France | 52/233 |
| 0033743 | 1/1922 | Norway | 52/233 |
| D. 180325 | 1/1936 | Switzerland | 52/540 |
| 374816 | 3/1964 | Switzerland | 52/233 |

OTHER PUBLICATIONS

Official Gazette, Jan. 2, 1934, B. R. Ward, 1,942,348 Log for Cabins and The Like.

*Primary Examiner*—David A. Scherbel
*Assistant Examiner*—Michele A. Van Patten
*Attorney, Agent, or Firm*—John C. Purdue; David C. Purdue

[57] ABSTRACT

A log for use in log construction is disclosed. The log comprises upper and lower, opposed major faces, a surface adapted to be an exterior, vertically extending surface in such a log construction, cooperating means provided on the upper and lower major faces for aligning a stack of plurality of such logs in a substantially vertical array and a flange comprising interior and exteriors surfaces adapted to be substantially vertically oriented in such a log construction. The flange is connected to and depends downwardly from the lower major face and is positioned so that its exterior surface constitutes an exterior surface in such a log construction. A channel surface is provided on the log, adjacent to the upper major face, and is adapted to be oriented substantially vertically, in such a log construction, opposite the interior surface of a flange of a corresponding log stacked on top of the log and forming therewith a channel. Also disclosed is the use of an expanding sealant in a channel formed in such a log construction.

9 Claims, 2 Drawing Sheets

LOG PROFILE AND LOG STRUCTURE INCORPORATING SAID LOG PROFILE

BACKGROUND OF THE INVENTION

1. Field of the Invention

This invention relates to the field of log construction and, more specifically, to a log profile for use in such construction. The profile facilitates the creation of a complete and long-lasting seal between adjacent logs in a structure.

2. Description of the Prior Art

A wide variety of log profiles have been developed for use in the field of log construction. Examples of such log profiles are illustrated in U.S. Pat. Nos. 1,942,347, 2,321,120, 3,440,784, 3,969,859, 4,126,977, 4,154,036, 4,312,161, 4,344,263, 4,356,676, 4,391,067, 4,391,077, 4,429,500 and 4,488,389.

Some of the profiles disclosed in these patents are designed to create a compression seal between opposed surfaces of adjacent logs. For example, U.S. Pat. No. 3,440,784 discloses a tongue and groove profile for logs wherein the tongues have sloping angled sides and the grooves have sloping angled sides and wherein the angles of these sides are slightly different to cause a "wedging action" to provide a "waterproof seal" (col. 3, Ins. 1 and 2). U.S. Pat. No. 1,942,348 discloses a stepped log profile including a vertically oriented surface on the upper and lower surfaces of the log.

U.S. Pat. No. 3,969,859 discloses a tongue and groove log profile and the use of a sealing material between contacting surfaces of adjacent logs. A drip edge arrangement, referred to in the patent as a longitudinal gap, is also disclosed. U.S. Pat. No. 4,126,977 discloses a tongue and groove log profile which "ensures that the two logs will always contact at the outer edge . . . " (col. 2, Ins. 38 and 39). U.S. Pat. No. 4,312,161 discloses a tongue and groove log profile wherein there is an arcuate surface on the tongue and a complimentary arcuate surface on the groove. U.S. Pat. No. 4,344,263 discloses a tongue and groove log profile and the provision of one or more slots in a log wherein the slots are filled with insulation. U.S. Pat. No. 4,429,500 discloses a similar tongue and groove log profile and a configuration for the ends of logs to facilitate the nesting of adjacent logs to form corners. U.S. Pat. No. 4,488,389 discloses a similar tongue and groove log profile and a metal bar for securing adjacent logs to one another in a log construction U.S. Pat. No. 4,391,067 discloses a log wall construction including filler panels provided between logs. U.S. Pat. No. 4,391,077 discloses a method of building which employs lengthwise stackable plank-like members wherein each such member has at least one transverse hole which aligns with a transverse hole in an adjacent member. Shear resisting members such as dowels are driven into the holes of the plank-like members after they are placed into position.

U.S. Pat. No. 4,356,676 discloses a sealant strip for adhesive attachment to and compression between structural members, for example, logs. U.S. Pat. No. 4,154,036 discloses a sealing strip for use in forming a weather seal between logs.

Many of these patent disclose the use of a sealing material in narrow channels formed between opposed, substantially horizontally oriented surfaces of adjacent logs. Such a sealing arrangement in a log construction is subject to rapid and sure degradation as the logs constituting the construction settle under their own weight subjecting the sealing material to extremely high compressive forces. Other sealing arrangements disclosed in some of the foregoing patents utilize logs with opposed surfaces provided with complimentary profiles wherein one surface is designed to fit tightly or wedge tightly against and engage the other surface, over long lengths of the logs. This can work with logs just after they are milled. However, logs are invariably subject to dimensional changes as a consequence of the wood drying out and absorbing moisture. In addition, the weight of logs in log construction can and does cause warping of logs, especially those at the bottom of a stack.

SUMMARY OF THE INVENTION

According to the present invention, there is provided a log for use in log construction. The log comprises upper and lower, opposed major faces and a surface adapted to be an exterior, vertically extending surface in such a log construction. Means, such as tongue and groove profiles, are provided on the upper and lower major faces for aligning a stack of a plurality of such logs in a substantially vertical array. According to the invention, a flange is connected to and depends downwardly from the lower major face of the log. The flange is positioned so that an exterior surface of the flange also constitutes an exterior surface in the log construction. Adjacent to the upper major face of the log, there is provided a channel surface oriented substantially vertically. In a log construction, the channel surface on the top face of one log will be opposite an interior surface of a flange of a corresponding log stacked on top of the log and form therewith a channel. In a log construction according to the invention, the channel is filled with an expandable material to provide a complete weather seal.

Accordingly, it is an object of the present invention to provide a log profiled to provide a channel surface and a flange which cooperate to form a channel for receiving a sealing material.

It is a further object of the invention to provide a weather seal in a log construction which is not subject to degradation due to pressure exerted thereon by the weight of logs stacked thereabove.

It is yet a further object of the present invention to provide a weather seal for log construction which will prevent the infiltration of moisture between the logs, and continue to do so even after the logs have become warped due to drying.

Other objects and advantages of the present invention will be apparent from the detailed description which follows, reference being made therein to the accompanying drawings in which like reference numerals are used to refer to like parts throughout the several views.

DETAILED DESCRIPTION OF THE INVENTION

Figure 1:
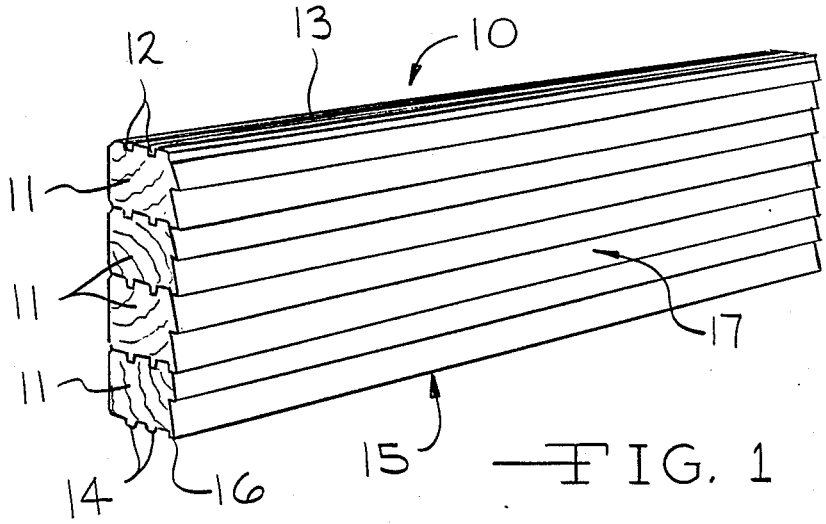
FIG. 1 is a perspective view of a one embodiment of a log construction according to the present invention.

Referring now to FIG. 1, a log construction according to the present invention is indicated generally at 10. The log construction 10 comprises individual, contoured logs 11 stacked one upon the other. Each log is provided with a pair of grooves 12 on an upper face 13 thereof and cooperating tongues 14 on a lower face 15 thereof. A flange 16 depends from the lower face 15 of each log 11, immediately adjacent to a side 17 of the log construction 10. The side 17 is adapted to be an exterior surface of the log construction 10, for the reasons discussed below.

Figure 2:
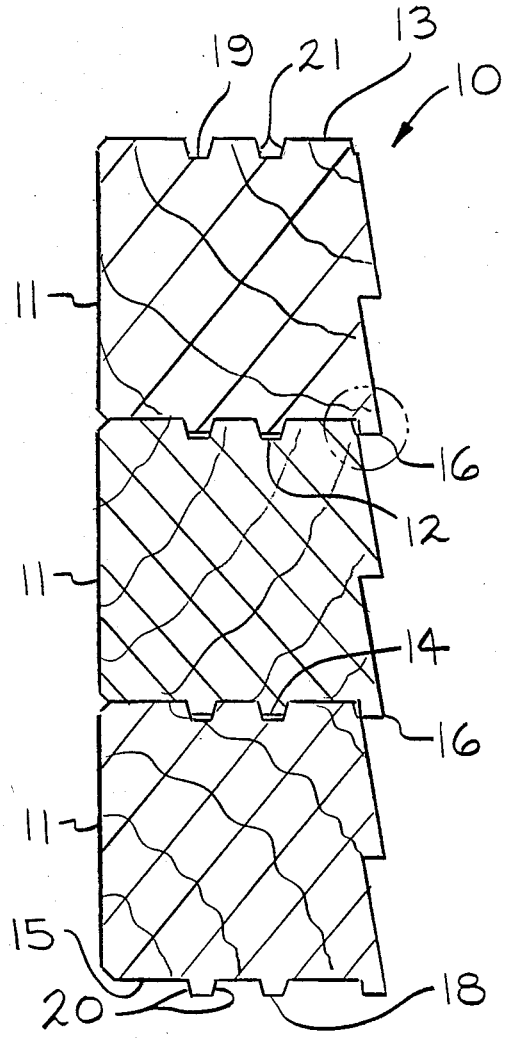
FIG. 2 is a cross-sectional view taken along the line 2—2 of FIG. 1 and illustrating one embodiment of a log profile according to the present invention.

Referring now to FIG. 2, the engagement between the grooves 12 and the tongues 14 is shown in more detail. The tongues 14 on the bottom face 15 of first log 11 are received in the grooves 12 on the upper face of a second log which is immediately below the first log 11. A small clearance is provided between a lower face 18 of the tongues 14 and a bottom surface 19 of the grooves 12. Sidewalls 20 of the tongues 14 converge towards the lower face 18 and sidewalls 21 of the grooves 12 correspondingly converge towards the bottom surface 19 thereof. Thus, the grooves 12 and the tongues 14 of a first log 11 cooperate with the tongue 14 of a second log 11, positioned immediately above the first log 11, and the grooves 12 of a third log 11, positioned immediately below the first log, respectively, to align all three logs 11 in a vertical stack or array, as shown in FIGS. 1 and 2.

Figure 3:
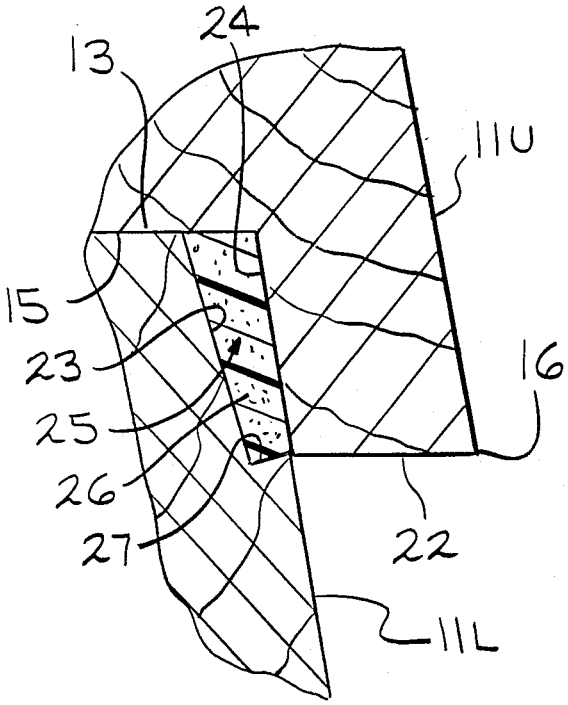
FIG. 3 is an enlarged, detailed view of the circled portion of FIG. 2.
Figure 4:
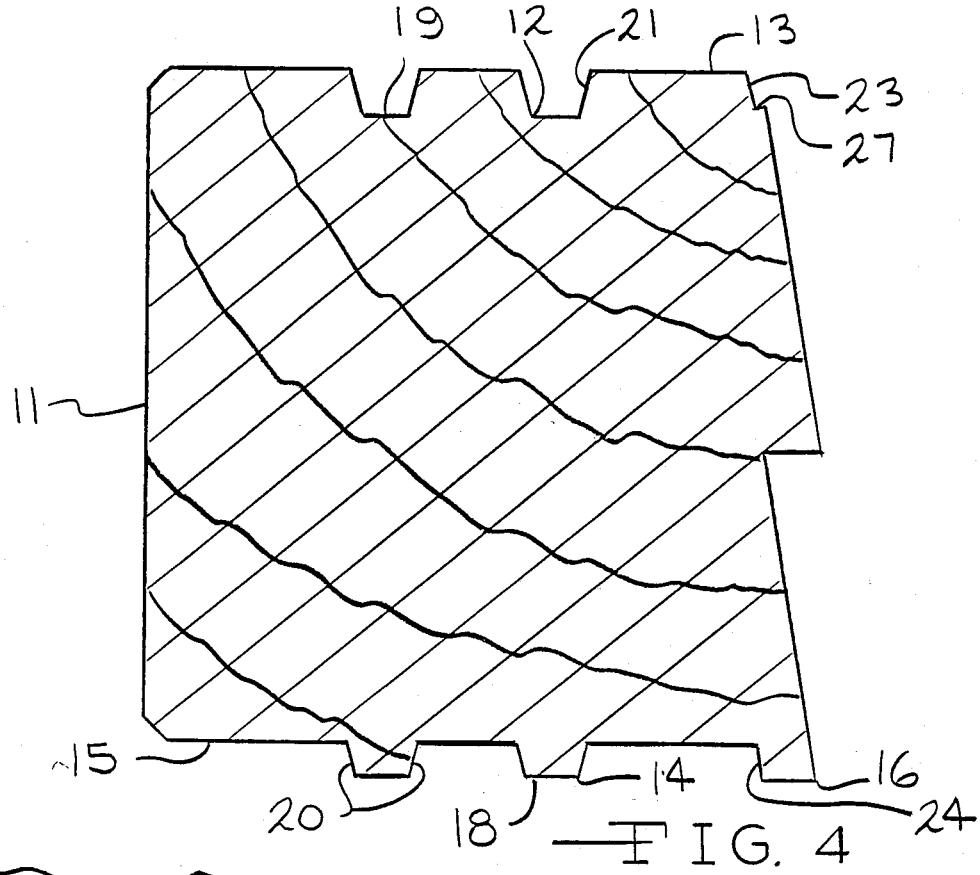
FIG. 4 is an enlarged, detailed cross-sectional view of one of the logs illustrated in FIG. 2.

As shown in FIG. 3, the flange 16 depends downwardly from the lower face 15 of an upper log 11U so that a free end 22 of the flange 16 of the upper log 11U extends below the upper face 13 of a lower log 11L positioned immediately therebelow. A channel surface 23 is formed in the lower log 11L, adjacent to the upper face 13. The channel surface is oriented substantially vertically. An inside surface 24 of the flange 16 is also oriented substantially vertically and defines, with the channel surface 23, a channel 25 which is filled with a sealant 26. The top of the channel 25 is defined by the lower face 15 of the upper log 11U and the bottom of the channel 25 is defined by a shoulder 27 formed in the lower log 11L. The shoulder 27 serves to retain the sealant 26 in the channel 25. In addition, the orientations of the inside surface 24 of the flange 16 and the channel surface 23 are related so that the channel 25 is narrower at the bottom than at the top. This feature also serves to retain the sealant 26 in the channel 25.

Thus, there is provided a log profile including upper and lower faces which cooperate to form a vertically oriented channel 25 for receiving a sealant 26. Because of the vertical orientation of the channel 25, the sealant 26 contained therein will not be subjected to enormous compressive forces as the weight of one log upon the other causes the log construction to settle. This feature distinguishes the present invention from known sealing systems in which a sealant is interposed between two substantially horizontal surfaces.

The flange 16 shields the sealant 25 from direct exposure to the elements. Nonetheless, the sealant 25 is positioned immediately adjacent to the exterior surface of the log construction. Consequently, the seal effected by the sealant 25 protects all of the horizontally oriented surfaces of the log construction by preventing water from reaching them from the exterior.

Figure 5:
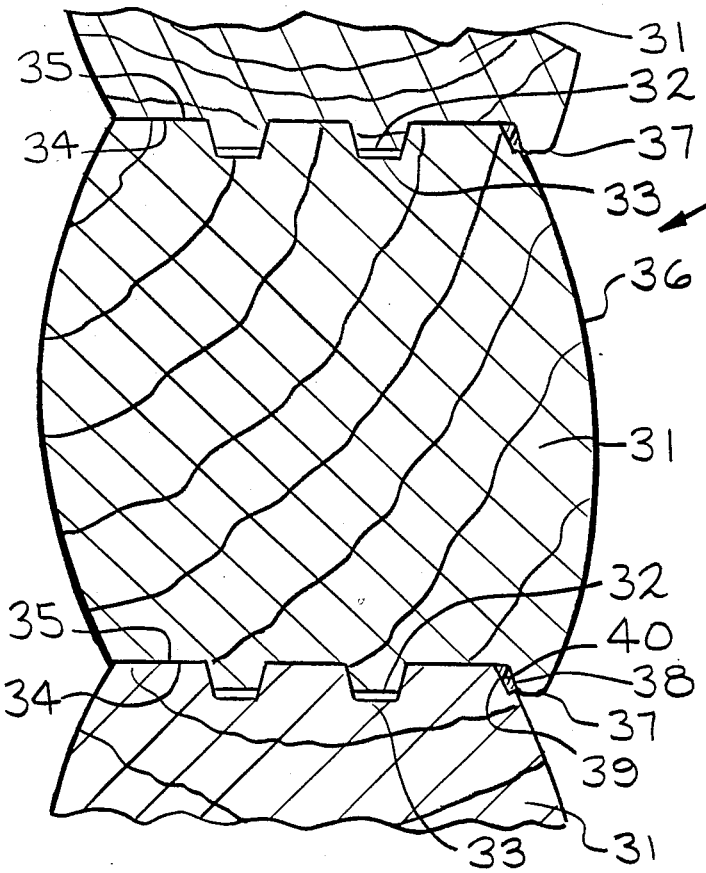
FIG. 5 is a partial cross-sectional view showing a second embodiment of a log profile and a log construction according to the present invention.
Figure 6:
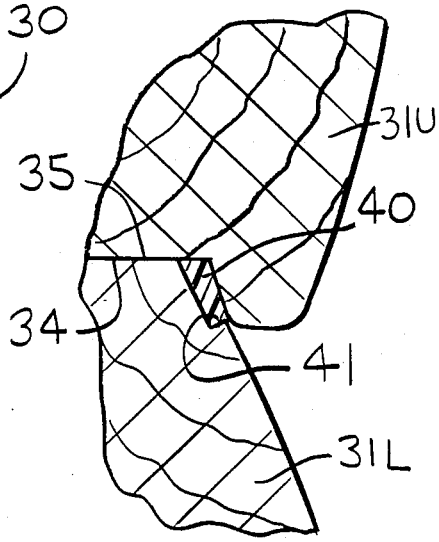
FIG. 6 is an enlarged, detailed view of the circled portion of FIG. 5.

FIGS. 5 and 6 illustrate another embodiment of my invention. A log construction 30 comprises a stack of logs 31. The logs 31 are similar to the logs 11 illustrated in FIGS. 14, except that the logs 31 have a more rounded profile. Tongues 32 and grooves 33 are provided on lower faces 34 and upper faces 35, respectively, of the logs 31. The tongues 32 and the grooves 33 cooperate to align the logs 31 in the log construction 30. Appropriate tolerances are provided between the tongues 32 and the grooves 33 so that settling of the logs 31 and warping of the logs 31 due to drying can be accommodated without undue stress or strain.

On a side 36 of the log 31 which is adapted to be an exterior side in the log construction 30, a flange 37 depends downwardly from the lower face 34. An inside surface 38 of the flange 37 cooperates with a channel surface 39 formed between the side 36 and the upper face 35 of the log 31 to define a channel which is filled with a sealant 40. As shown most clearly in FIG. 6, the channel is wider at the top and narrower at the bottom. Thus, the sealant 40 is retained in the channel by a wedging action. A shoulder 41 of a lower log 31L defines the bottom of the channel and the top of the channel is defined by the lower face 34 of an upper log 31U. The shoulder 41 also serves to retain the sealant 40 in the channel.

A wide variety of sealants would be suitable for use in the present invention. I prefer, however, to use an expanding or foaming sealant. Specifically, I prefer a product called "150 Impregnated Pre-compressed Expanding Sealant Tape" which is available from the Will-Seal Division of Illbruck. This product expands, in-situ, up to five times its original size so it is well-suited for this application where it can expand to seal against the surfaces which define the channel, even where there are irregularities in these surfaces. It is well within the ability of one skilled in the art to select other, suitable and effective sealants and their use is within the scope of the present invention.

The foregoing description of the preferred embodiments of my invention is intended to enable one skilled in the art of log construction to practice my invention, and to illustrate but not limit it anymore than it is limited in the appended claims.

I claim:

1. A log wall construction comprising a plurality of vertically stacked logs wherein a substantial portion of the weight of the logs near the top of the stack is supported by logs near the bottom of the stack, said log wall construction including a plurality of logs each comprising:

upper and lower, opposed major faces;

an exterior surface;

cooperating means provided on the upper and lower major faces aligning said plurality of logs in a substantially vertical stack;

a flange comprising interior and exterior surfaces substantially vertically oriented, said flange being connected to and depending downwardly from said lower major face so that said exterior surface of said flange constitutes an exterior surface of the wall;

a channel surface positioned adjacent to the upper major face of the log, said channel surface being oriented substantially vertically, in the log wall, opposite and spaced substantially apart from the interior surface of the flange formed on the log positioned above said log and forming therewith a channel; and a sealant material carried in the channels so formed.

2. The log wall construction claimed in claim 1 wherein the logs are shaped so that the inside surface of the flange and the channel surface are oriented so that the channels formed therebetween are narrower at the bottom than at the top.

3. The log wall construction claimed in claim 1 wherein the logs are shaped so that said flange terminates in a free end which extends below the lower major face of the log.

4. The log wall construction claimed in claim 3 wherein said cooperating means comprise grooves formed in the upper major faces of said logs and tongues formed in the lower major faces of said logs.

5. The log wall construction claimed in claim 1 wherein said cooperating means comprise grooves formed in the upper major faces of said logs and tongues formed in the lower major faces of said logs.

6. The log wall construction claimed in claim 1 wherein said sealant is one which expands in-situ.

7. A log for use in log construction, said log comprising:

upper and lower, opposed major faces;

a surface adapted to be an exterior, vertically extending surface in such a log construction;

at least one groove and a complimentary tongue formed in the upper and lower major faces, respectively, for aligning a stack of plurality of such logs in a substantially vertical array;

a flange comprising interior and exterior surfaces adapted to be substantially vertically oriented in such a log construction, said flange being connected to and depending downwardly from said lower major face, said flange being positioned so that said exterior surface of said flange constitutes an exterior surface in such a log construction;

a channel surface positioned adjacent to the upper major face of the log, said channel surface being adapted to be oriented substantially vertically, in such a log construction, opposite and spaced substantially apart from the interior surface of a flange of a corresponding log stacked on top of the log and forming therewith a channel, wherein, when a plurality of such logs are stacked in a vertical array, a substantial portion of the weight of the logs near the top of such array is supported by logs at the bottom of such array.

8. The log claimed in claim 7 wherein the inside surface of the flange and the channel surface are oriented so that a channel formed therebetween when a plurality of such logs are stacked one upon the other is narrower at the bottom than at the top.

9. The log claimed in claim 7 wherein said flange terminates in a free end which extends below the lower major face of the log.

* * * * *